US010391035B2

(12) United States Patent
Häfner et al.

(10) Patent No.: US 10,391,035 B2
(45) Date of Patent: Aug. 27, 2019

(54) MEDICATION SYSTEM WITH A MEDICATION TRAY AND METHOD FOR CREATING A DELIVERY-READY MEDICATION SYSTEM

(71) Applicant: MEDINOXX GMBH, Innsbruck (AT)

(72) Inventors: Jens Häfner, Innsbruck (AT); Stefan Neussl, Innsbruck (AT)

(73) Assignee: MEDINOXX GMBH, Inssbruck (AT)

( * ) Notice: Subject to any disclaimer, the term of this patent is extended or adjusted under 35 U.S.C. 154(b) by 0 days.

(21) Appl. No.: 15/774,572

(22) PCT Filed: Nov. 8, 2016

(86) PCT No.: PCT/EP2016/076934
§ 371 (c)(1),
(2) Date: May 8, 2018

(87) PCT Pub. No.: WO2017/080981
PCT Pub. Date: May 18, 2017

(65) Prior Publication Data

US 2018/0318172 A1 Nov. 8, 2018

(30) Foreign Application Priority Data

Nov. 10, 2015 (AT) ..... A 50954/2015

(51) Int. Cl.
*A61J 7/00* (2006.01)
*A61J 1/03* (2006.01)
(Continued)

(52) U.S. Cl.
CPC ..... *A61J 7/0069* (2013.01); *A61J 1/03* (2013.01); *A61J 1/035* (2013.01); *B65B 3/003* (2013.01);
(Continued)

(58) Field of Classification Search
CPC .. A61J 7/0069; A61J 1/03; A61J 1/035; A61J 2205/30; B65D 1/30; B65D 21/0206;
(Continued)

(56) References Cited

U.S. PATENT DOCUMENTS 2,115,021 A * 4/1938 Joffee ..... B65D 5/48038 206/459.5
3,844,408 A 10/1974 Relyea
(Continued)

FOREIGN PATENT DOCUMENTS

DE 19510732 C1 5/1996
DE 20 2006 021 043 U1 1/2012
(Continued)

*Primary Examiner* — J. Gregory Pickett
*Assistant Examiner* — Brijesh V. Patel
(74) *Attorney, Agent, or Firm* — Maschoff Brennan

(57) ABSTRACT

A medication system with a medication tray includes a substantially rectangular tray sheet with individual receiving sites, which are separated from each other and run in rows. A plurality of containers of the medication system contain medications which are positioned in the receiving sites such that they are individually removable. Plastic film, which is provided with perforations along the outer contours of the containers, is sealed to the edges of the containers. The tray is a plastic injection-molded part. Each container is individually provided with a plastic film which is sealed to the edge of the container, and which originates from a single flexible plastic film provided with perforations along the outer contours of the containers, which has been welded only along the container edges. The non-welded part of the plastic film forms a foil mesh, which is removed by cutting through it in the area of the perforations.

15 Claims, 10 Drawing Sheets

Figure 1:
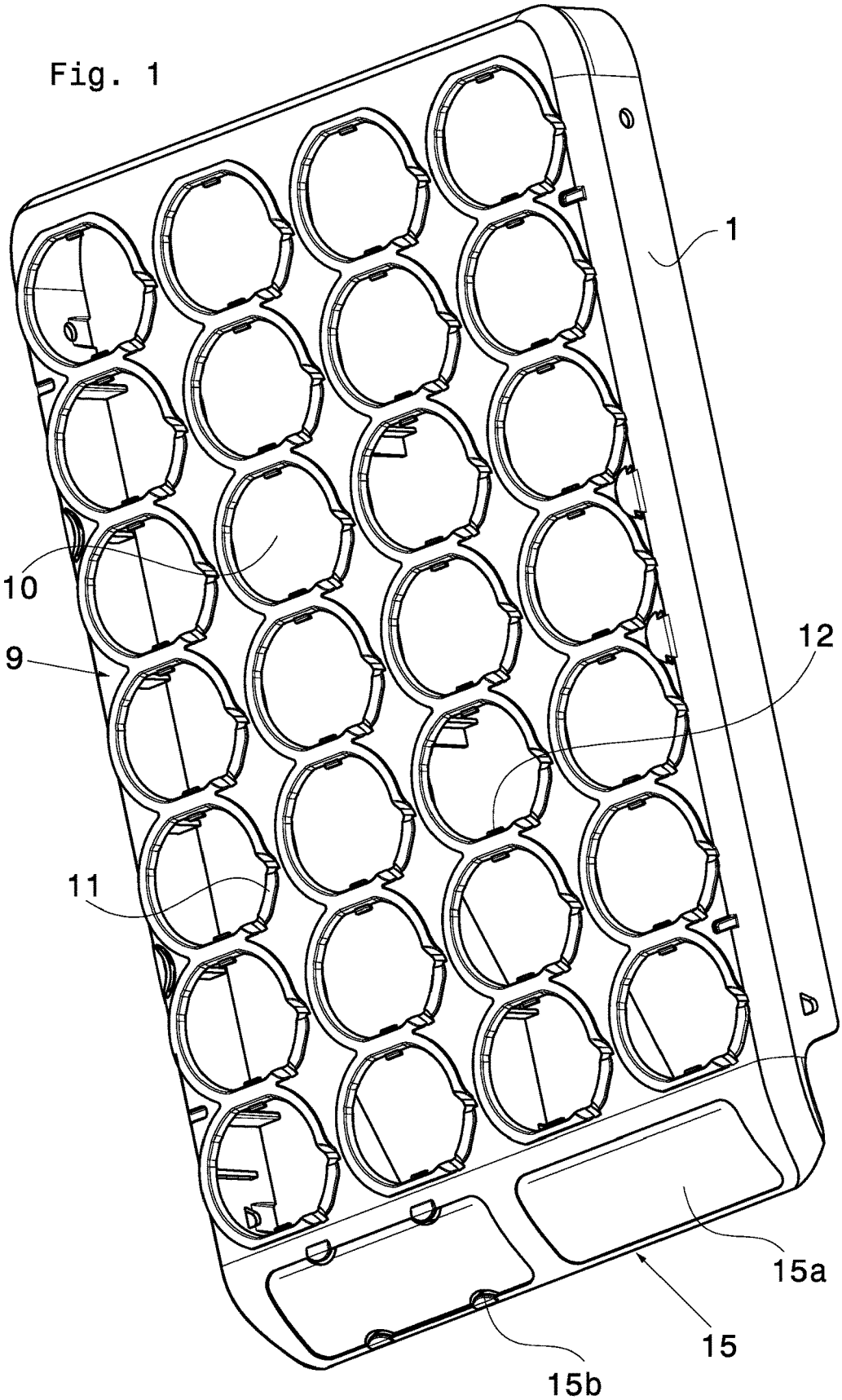

(51) Int. Cl.

| | |
|---|---|
| ***B65B 3/00*** | (2006.01) |
| ***B65B 7/28*** | (2006.01) |
| ***B65D 71/70*** | (2006.01) |
| ***B65D 77/20*** | (2006.01) |

(52) U.S. Cl.
CPC ..... *B65B 7/2842* (2013.01); *B65D 71/70* (2013.01); *B65D 77/2024* (2013.01); *A61J 2205/30* (2013.01)

(58) Field of Classification Search
CPC ..... B65D 2543/00296; B65D 2543/00842; B65D 2577/2066; B65D 75/327; B65D 77/2024; B65D 71/70; B65B 7/2842; B65B 3/003
USPC ..... 206/538, 534, 561, 820, 459.5, 532, 206/459.1; 220/23.4, 23.83, 23.86, 359.1
See application file for complete search history.

(56) References Cited

U.S. PATENT DOCUMENTS 5,011,018 A * 4/1991 Keffeler ..... B65D 83/0445 206/532
5,050,756 A * 9/1991 Tielker ..... B25H 3/06 206/501
5,788,079 A * 8/1998 Bouthiette ..... A61J 7/0069 206/534
7,308,984 B2 * 12/2007 Bouthiette ..... A61J 1/035 206/484.2
7,661,530 B1 * 2/2010 Hewitt ..... A45C 11/24 206/528
7,828,149 B2 * 11/2010 Kalvelage ..... B65D 75/367 206/532
8,607,983 B2 * 12/2013 Niven ..... A61J 1/035 206/538
9,271,898 B2 * 3/2016 Flynn ..... A61J 7/0069
2007/0095719 A1 * 5/2007 Colavito ..... B31D 5/0021 206/561
2009/0008395 A1 * 1/2009 Sattler ..... B01L 3/50853 220/507
2012/0060450 A1 * 3/2012 Burns ..... A61J 7/0069 53/467
2013/0299499 A1 * 11/2013 Elliott ..... B65D 75/327 220/359.1
2015/0041357 A1 * 2/2015 Proulx ..... A61J 1/035 206/532

FOREIGN PATENT DOCUMENTS

| | | | |
|---|---|---|---|
| EP | 2 194 952 | B1 | 8/2013 |
| ES | 1126055 | U | 10/2014 |
| WO | 02092439 | A2 | 11/2002 |
| WO | 2005/023670 | A1 | 3/2005 |
| WO | 2009/047560 | A1 | 4/2009 |
| WO | 2013/050577 | A1 | 4/2013 |
| WO | 2017/080981 | A1 | 5/2017 |

* cited by examiner

MEDICATION SYSTEM WITH A MEDICATION TRAY AND METHOD FOR CREATING A DELIVERY-READY MEDICATION SYSTEM

The invention relates to a medication system with a medication tray having a substantially rectangular tray sheet with a number of individual receiving sites, which are separated from each other and run in rows, and having a plurality of containers containing liquid or solid medications, which are positioned in the receiving sites such that they are individually removable, wherein plastic film, which is provided with perforations along the outer contours of the containers, is sealed to the edges of the containers. The invention also relates to a method for preparing a delivery-ready medication system with a medication tray, which comprises a substantially rectangular tray sheet with a number of individual receiving sites for individual containers holding medicines, which are separated from each other and run in rows.

A medication system with a medication tray is known from EP 2 194 952 B1. A film which seals the individual containers extends over the upper side of the tray and therefore also over all of the containers, which are positioned in the receiving sites. The film is therefore welded to both the edge regions of the containers and the surface regions of the tray sheet in between. In each container the film is perforated along the outer contour of the edge, in order to enable the selective removal of individual perforated containers, while containers that are not removed are retained and remain closed and sealed. To remove the medications contained in the containers, the piece of film which forms their cover is removed. With this known packaging system, the trays are not reusable and in the facilities where the system is used, a relatively large amount of voluminous plastic waste is produced. The trays produced by deep-drawing are thin-walled and unstable, which makes their handling more difficult.

The object of the invention is to provide a medication system with a reusable, stable medication tray that is convenient to handle. The tray should therefore also be easy to clean, and in particular, dishwasher-proof. A further object of the invention is to provide a simple method for preparing a medication system with a delivery-ready and reusable medication tray.

With regard to the medication system, the object is achieved according to the invention by the fact that the tray is a plastic injection moulded part, and that each container is individually provided with a plastic film, which is sealed to the edge of the container and which originates from a single flexible plastic film provided with perforations along the outer contours of the containers which has been welded only along the container edges, and the non-welded part of which, forming a film mesh, has been removed by cutting through it in the area of the perforations.

The method according to the invention provides the following steps:

inserting the containers into the receiving sites of the tray sheet, filling the containers with medications, positioning a single flexible plastic film, which is provided with perforations along the outer contours of the containers, on the tray sheet and the containers, sealing the film only along the edges of the containers, removing the non-welded part of the film, which forms a film mesh, from the tray by cutting through it in the area of the perforations.

The embodiment according to the invention of the tray as a plastic injection-moulded part, to which the film accordingly is not welded, ensures the re-usability, a high degree of stability, a comfortable and improved handling, and the possibility of optimal cleaning. The medication system can be brought to the delivery-ready condition in a simple and convenient manner.

In a preferred embodiment of the invention, the containers are positioned in the receiving sites of the tray sheet by means of at least one snap-in connection, such that they can be removed and used again. This measure protects the containers against accidental loss and facilitates the handling of the medication system according to the invention.

For reasons of weight it is also advantageous if the receiving sites of the tray sheet in accordance with the invention are openings.

In another particularly advantageous embodiment of the invention, the above-mentioned snap-in connection has a projection formed on the inner edge of the receiving site and at least one projection formed on the container edge. In the engaged or snap-fitted condition of the container, the projection formed on the container is located below the rim of the receiving site.

A safe storage of the tray is ensured according to a further feature of the invention by a design in which an edge part running substantially perpendicular to the tray sheet is provided on the two long sides, and preferably also on at least one of the end faces of the tray sheet.

A particularly advantageous embodiment of the invention is one in which a cover-like receptacle, in particular for the storage of administration instructions or patient information or the like, is arranged on the edge part of the tray sheet such that it can be pivoted open, wherein the receptacle is detachably connected to the edge part of the tray by means of a snap-fit connection. The releasable arrangement of the receptacle provided from the tray sheet offers advantages in the positioning of the above-mentioned administration instructions or patient information leaflet, and also in relation to cleaning the trays.

In another preferred embodiment of the invention, a slanted front part is formed on an end face of the tray sheet with panels for affixing labels. On this front part an additional individual labelling of the tray can therefore be provided in a removable form, for example by means of stick-on and removable labels, appropriately labelled, which are positioned in the panels designed in particular as shallow depressions.

In a particularly advantageous embodiment each container comprises a cup, on which an edge of the cover is seated, and having a surface which extends in the plane or parallel to the plane of the tray sheet and to which the film is sealed, forming a film lid. The edge of the cover is advantageously designed in such a way that it can be removed and replaced again together with the film which is sealed thereto.

In a further embodiment of the invention the cups are produced integrally with an edge part, which has a surface for welding onto the film. In this case, it is provided that the containers can be opened by pulling off the film. In this design variant no re-closure is possible.

In a particularly simple and logical way, the delivery-ready condition of the medication system can be prepared by a number of a plurality of containers, arranged in a row and connected to each other via connection points, being placed in the tray, wherein the connection points are mechanically or thermally separated during the sealing process The sealing, which can be carried out in particular by welding or an adhesion process, is simplified by the fact that the container edges forming the sealing surfaces are in the plane of the tray sheet.

The plastic film can be easily imprinted before being positioned within the separating lines formed by perforations, in particular by punching. These areas are also those which, after the removal of the part of the film that forms a film mesh, form the film lids of the containers.

Figure 2:
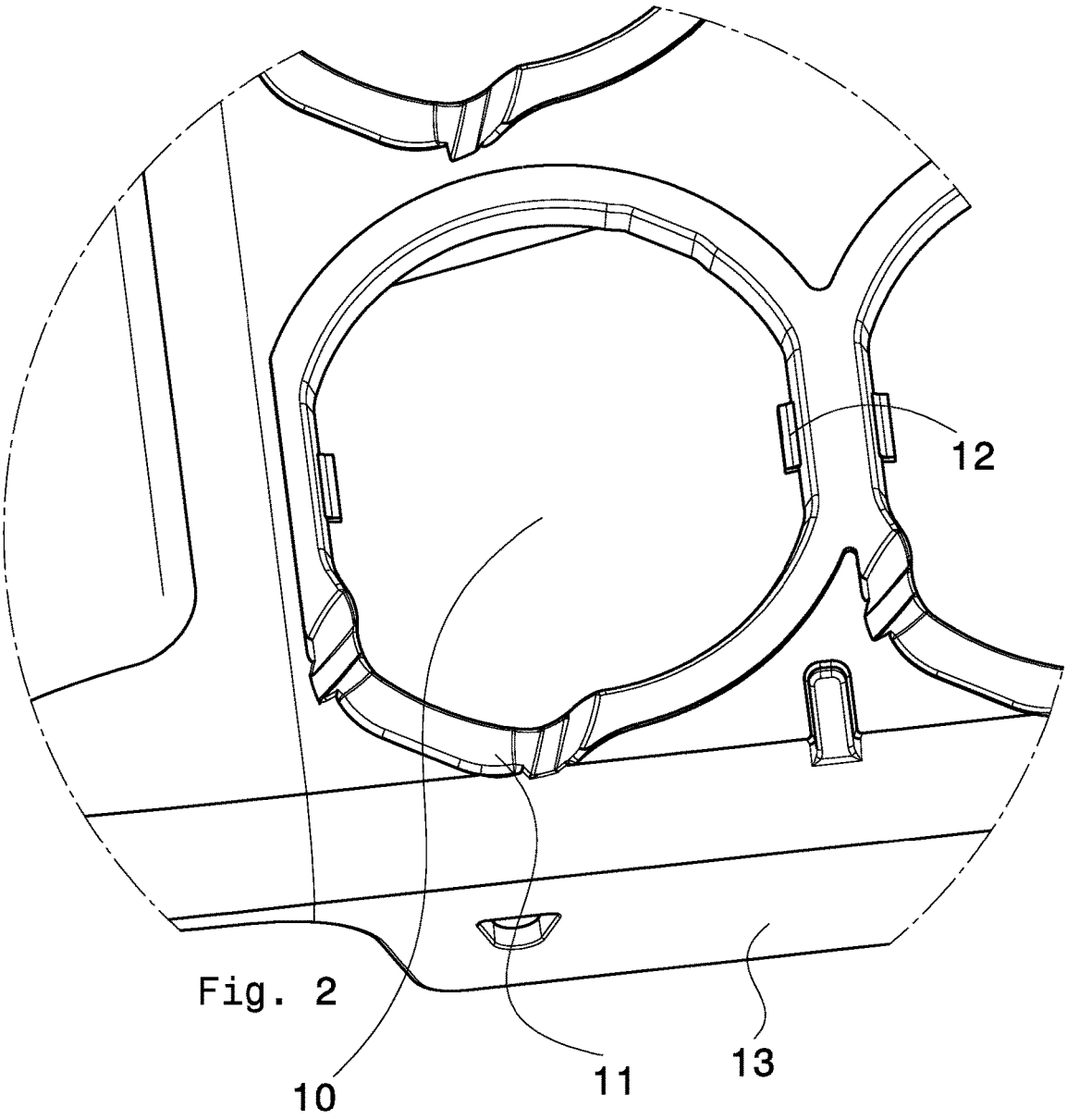
Figure 3:
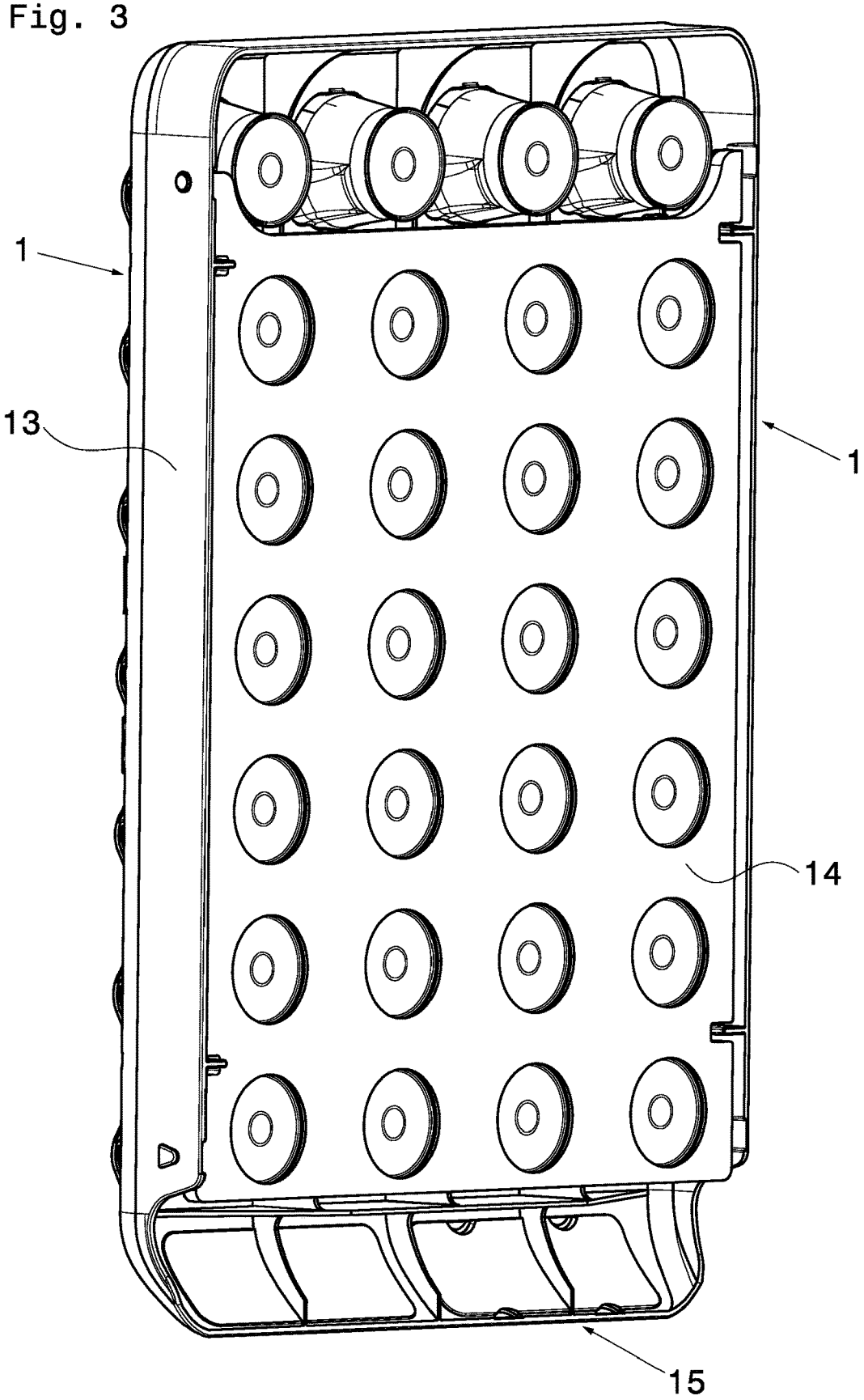
Figure 4:
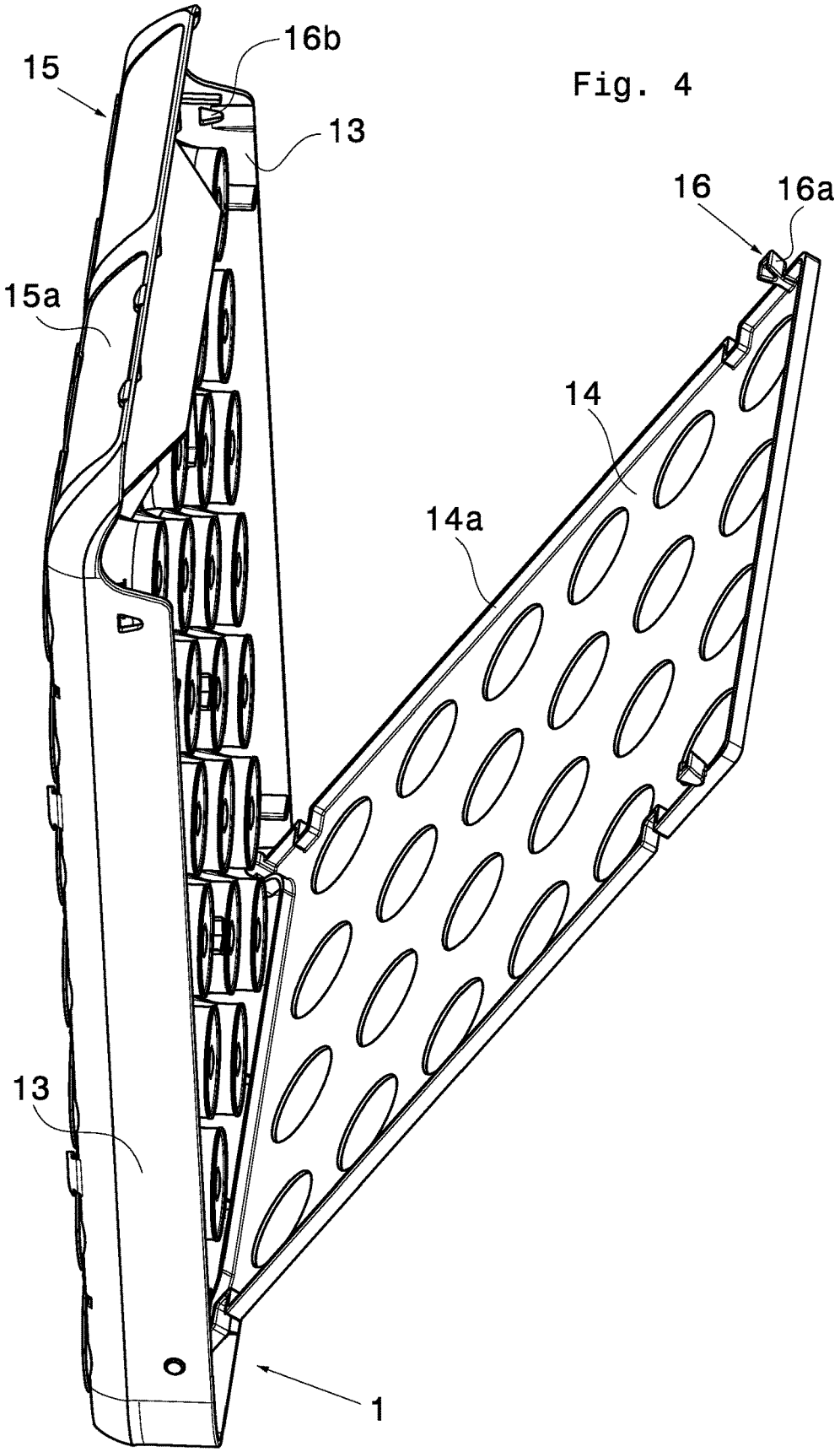
Figure 6:
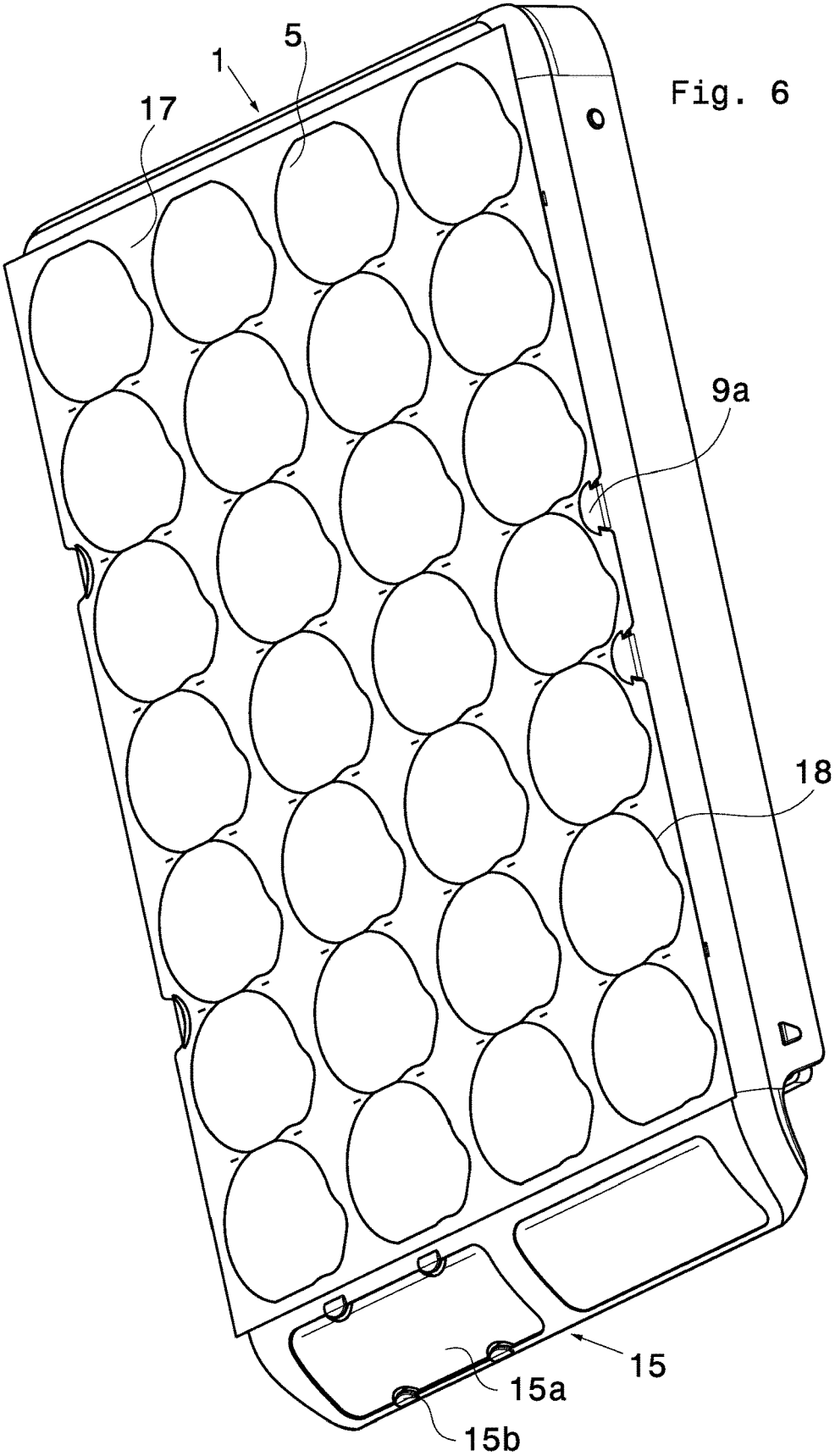
Figure 6A:
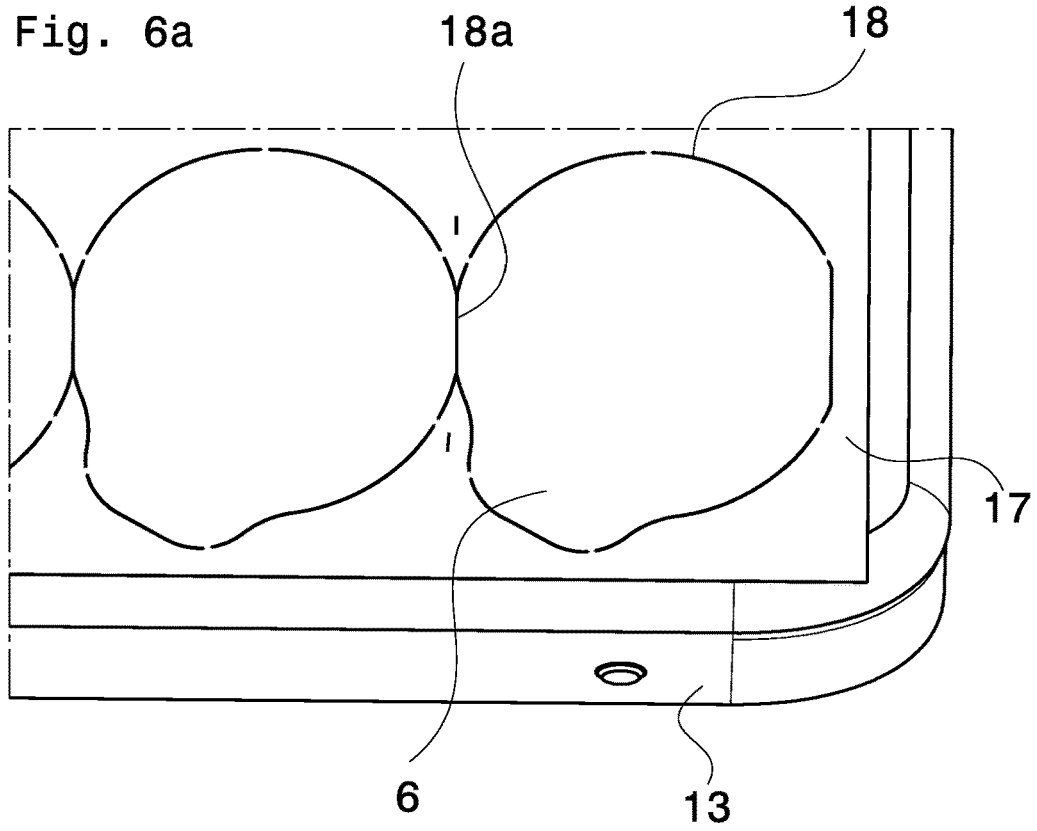
Figure 7A:
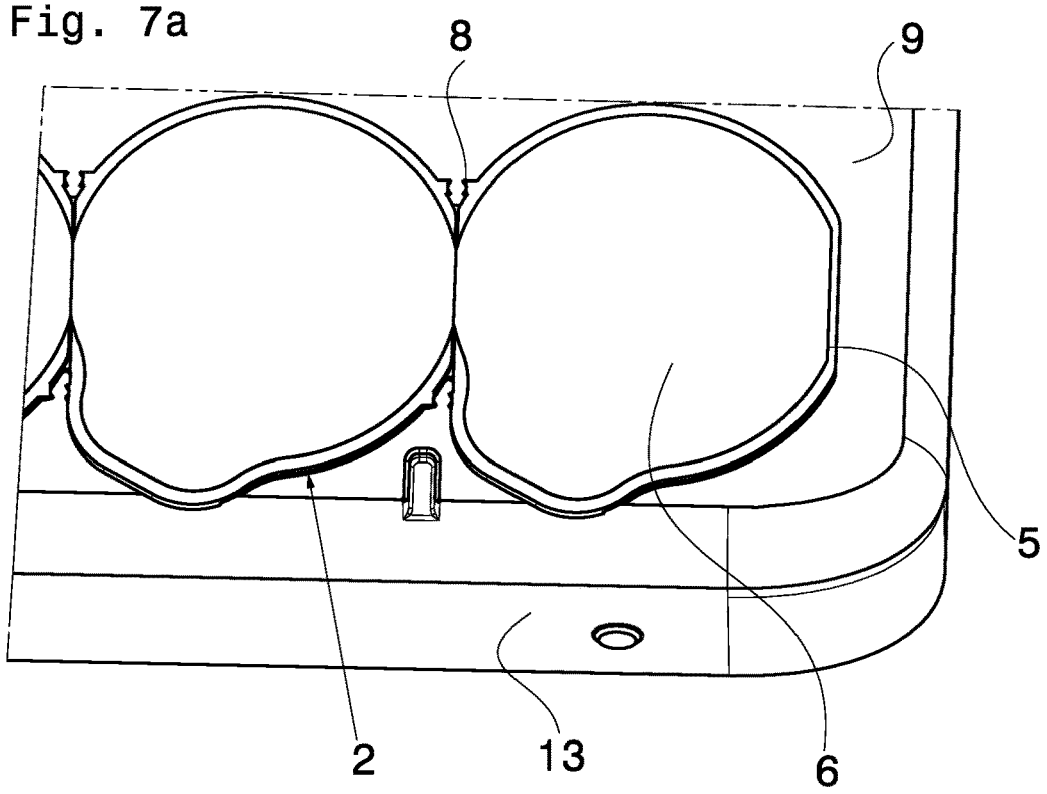
Figure 7:
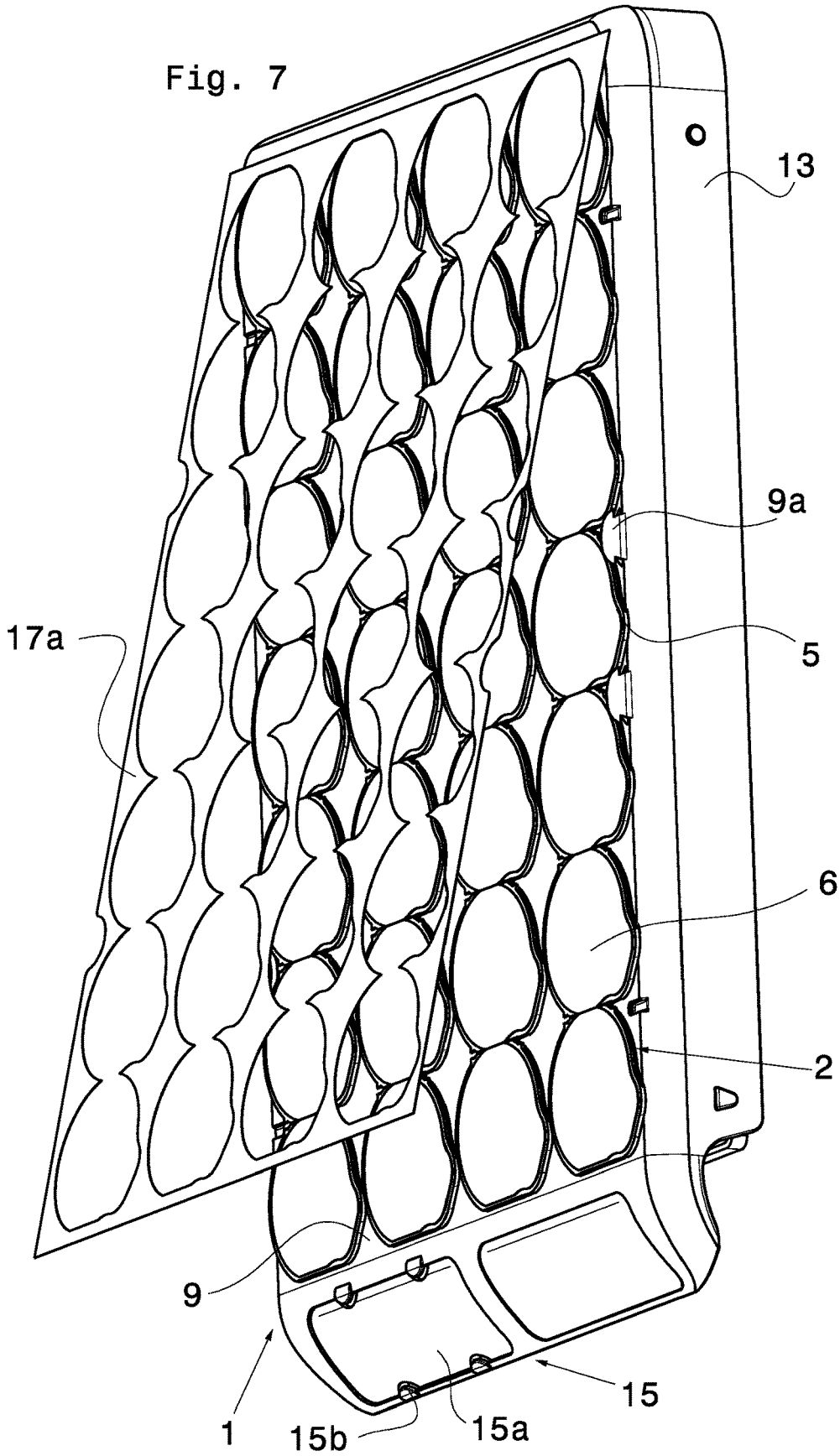
Figure 8:
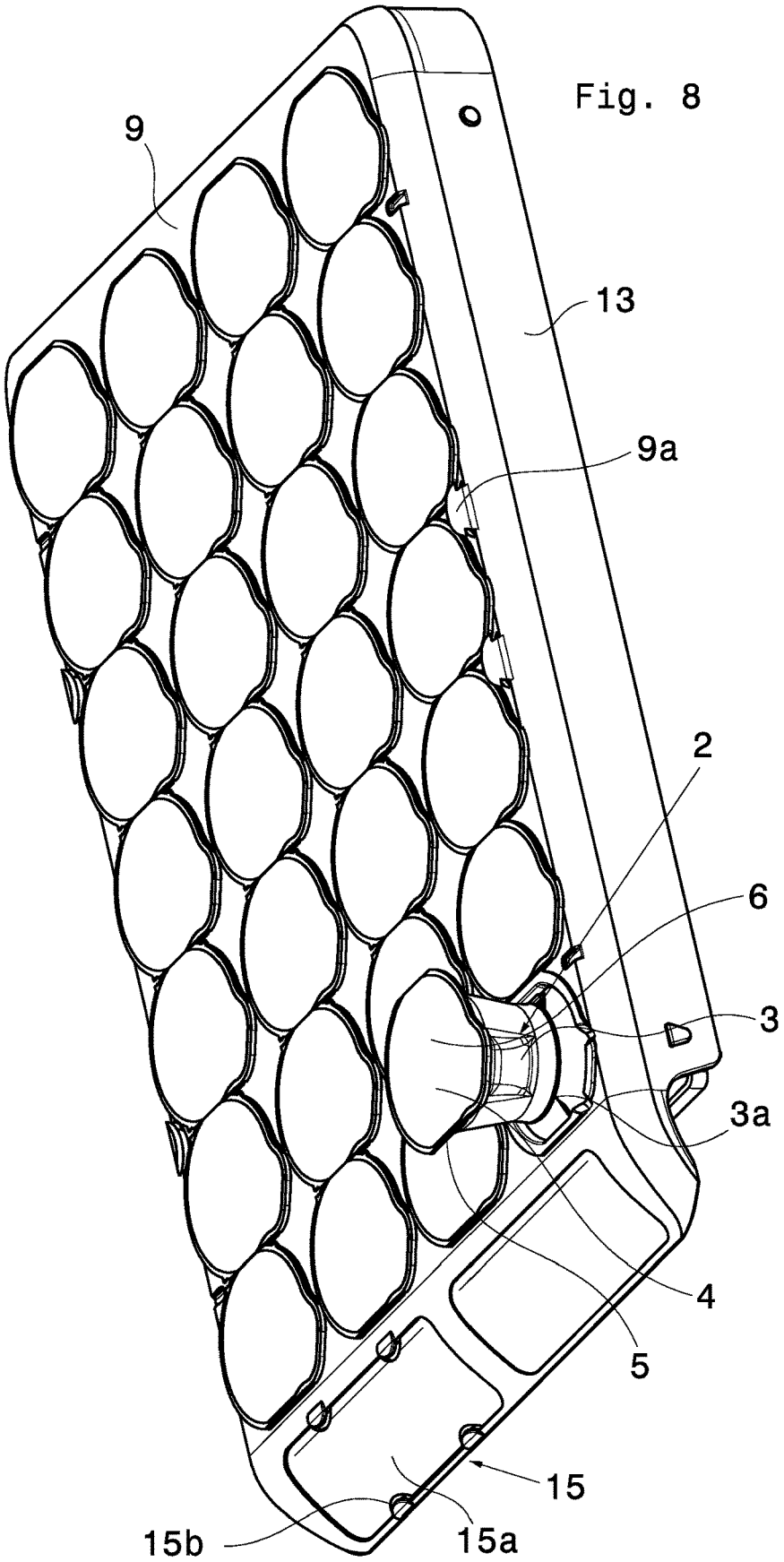
Figure 9:
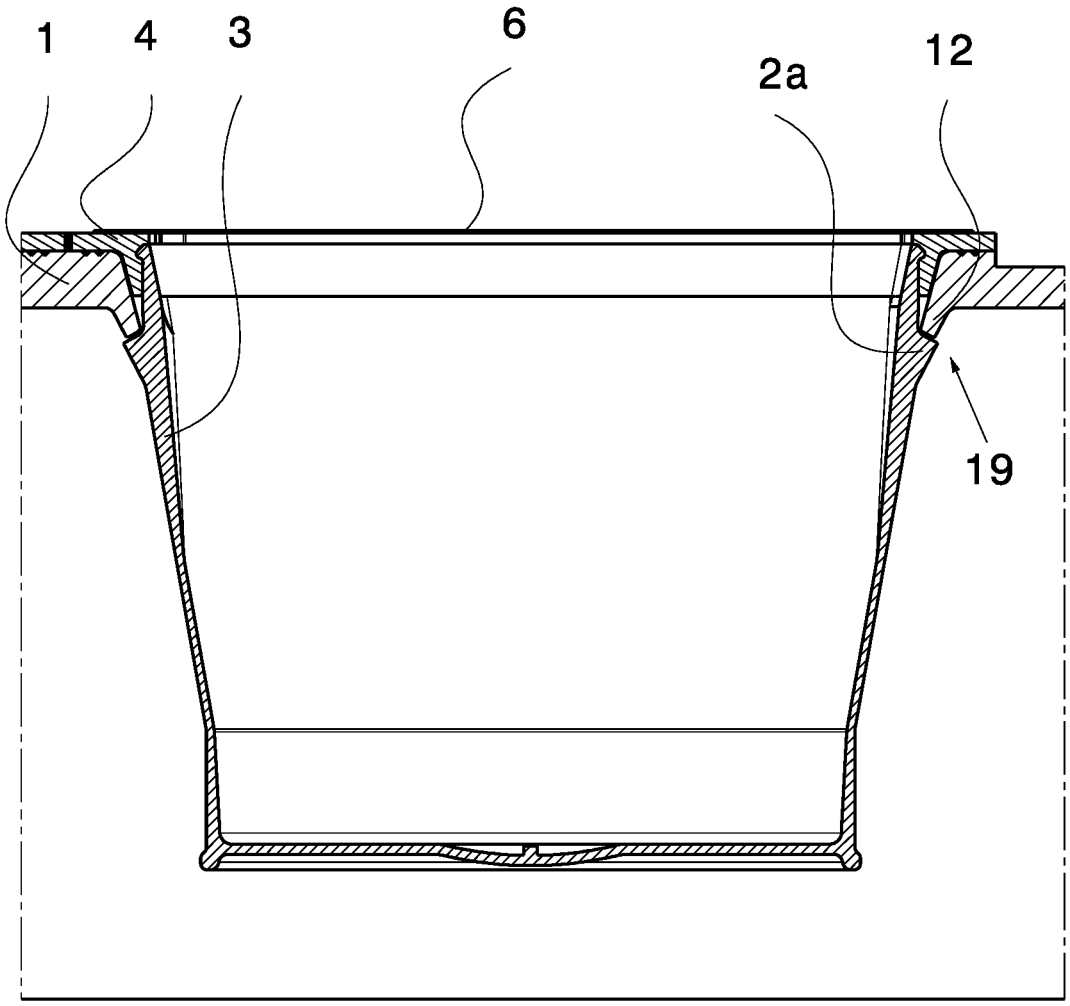

Additional features, advantages and details of the invention will now be described in more detail by reference to the drawing, which shows exemplary embodiments. These show:

FIG. 1 an oblique view of a tray sheet of a tray according to the invention from above, FIG. 2 a detail of FIG. 1, FIG. 3 a view of the tray with a closed receptacle from below FIG. 4 an oblique view of the underside of the tray, with an open receptacle FIG. 5 to FIG. 7 different stages in the production of a finished tray which is ready for delivery, FIG. 6*a* a detail of FIG. 6 in an enlarged view, FIG. 7*a* a detail of FIG. 7 in an enlarged view, FIG. 8 a view of the tray with positioned containers in the delivery condition and FIG. 9 a cross-sectional view through a container held in the tray.

The invention relates to a medication packaging system—a medication system—for providing medicines in liquid, solid or paste form, for example, drugs that exist in the form of powder, drops, tablets, capsules, creams, liquids, and the like. The use of the medication system according to the invention for providing drugs dispensed for each patient individually is particularly advantageous, both in in-patient facilities, such as nursing homes, homes for the elderly, out-patient care services and the like, but also in the private sector. It is primarily the nursing staff and patients in inpatient facilities, but also pharmacies who perform the dispensing who will benefit from the medication system according to the invention.

The main components, or essential parts of the medication system according to the invention, are a medication tray 1 and a plurality of identically designed containers 2, in which the medicines are packed in the appropriate dosage matched to the time of administration. As shown in particular in FIG. 8, each container 2 consists of a cup 3 and a lid 4, which in a preferred embodiment is implemented as a resealable lid. The cup 3 has a preferably round, in particular cylindrical base 3*a* and joined to this, a diameter which increases in the direction of its upper rim. The cup 3 consists of a preferably transparent plastic material and has, for example, a fluid holding capacity of preferably 10 ml or 15 ml, but up to a maximum of approximately 45 ml. The lid 4 has a lid edge 5 surrounding the upper rim of the cup 3 and matched to the contour of this rim, which is a separate part from the cup 3 and is connected to the upper rim of the cup 3 in a liquid-tight, but detachable manner. The lid edge 5 externally overhangs the upper rim of the cup 3 and has, for example, a 2 mm to 4 mm wide, flat surface. In the finished condition ready for delivery and use, at least one liquid or solid medicine is located in the container 2, wherein a preferably transparent covering film 6, spanning the edge of the lid 5 and closing off the cup 3, is sealed in particular by gluing or welding, to the surface of the lid edge 5, as will be described in detail below, so that the medicines are provided in containers 2 fitted with a detachable and re-attachable lid 4.

Figure 5:
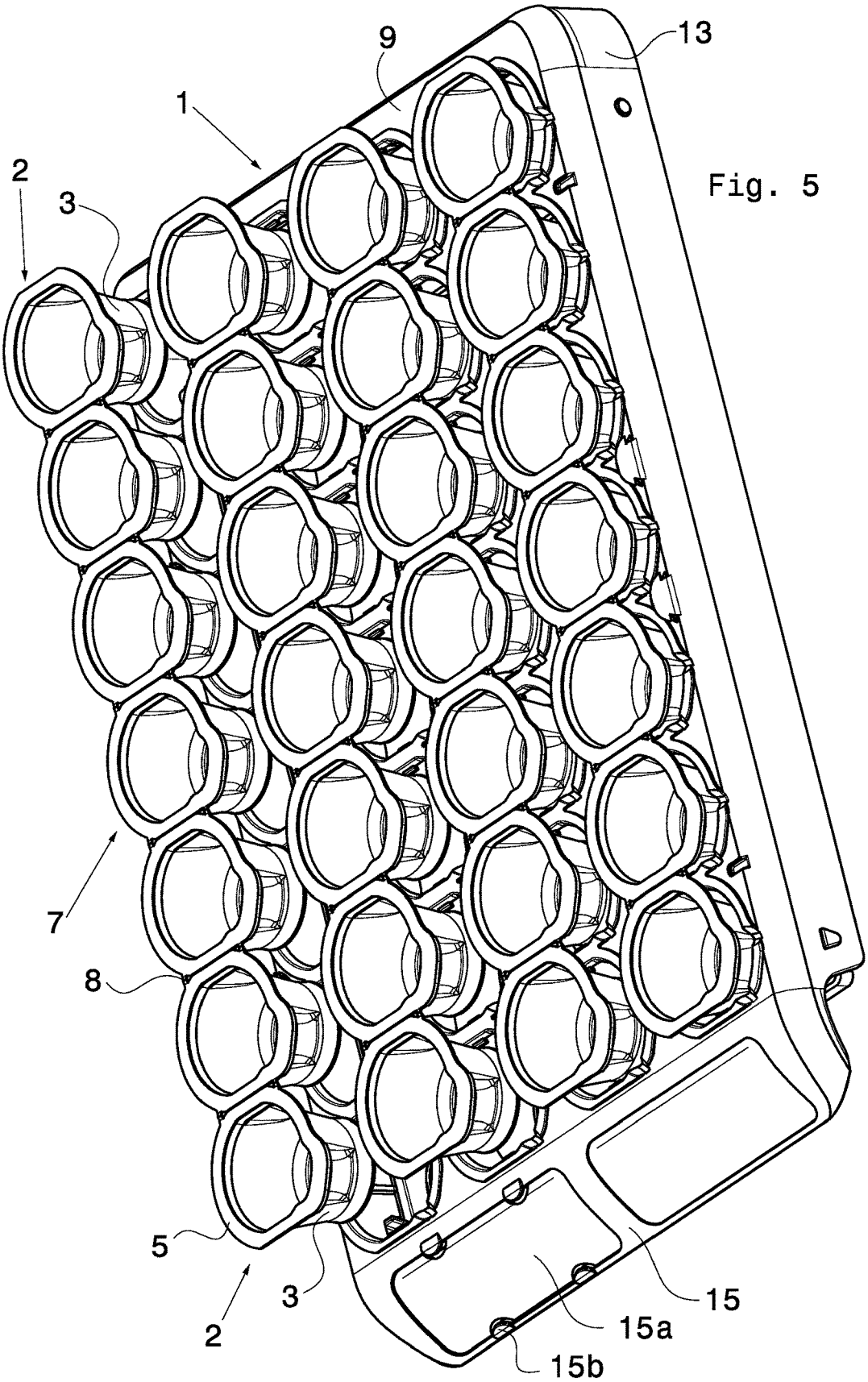

The container 2 consisting of cup 3 and lid edge 5 is produced in a two-component injection moulding process, wherein an assembly 7 is produced consisting of a number of cups 3, for example seven cups 3 as shown for example in FIG. 5, each with lid edge 5 but still without the covering film 6. The individual cups 3 of an assembly 7 are connected to each other at the lid edges 5 via local connections 8. As shown, for example, in FIG. 5, these connections 8 can be thin points, such as webs, between the lid edges 5 of adjacent cups 3. Other embodiments, for example as thin skins, are also possible.

In plan view, the tray 1 manufactured from plastic by injection moulding, is substantially rectangularly designed, its length is tailored to the number of containers 2 per assembly 7 and its width to the number of assemblies 7. The tray 1 in the figures shown is provided for holding four assemblies 7 each consisting of seven containers 2. Fewer than or more than four assemblies, for example six assemblies 7, are also possible. The tray 1 has a flat tray sheet 9 with receiving sites 10 for the individual containers 2 of the assemblies 7. The receiving sites 10 in the embodiment shown are openings in the tray sheet 9, the contours of which are matched to the design or configuration and contour of the cup 3 at its upper rim region. The receiving sites 10 are each surrounded by a low elevated portion 11, which is matched to the outer contour of the lid edges 5, so that with the cups 3 inserted the surfaces of the lid edges 5 extend in a single plane, which is located either slightly above the plane of the tray sheet 9, by approximately 0.5 mm, or else in the plane of the tray sheet 9. At the inner edge region of the receiving sites 10, two protrusions 12 are formed diametrically opposite each other, below which protrusions 2*a* snap into place on the cup wall when the cups 3 are inserted, so that the containers 2 in the tray 1 are secured against accidental loss, but can still be removed from the tray 1 without the exertion of any special effort. Also, due to the projections 2*a*, 12 snapping into place when the film mesh 17*a* is removed (FIG. 7), as described below, the cups 3 are secured in the receiving sites 10 and held in position.

On the two longer sides and on one of the end faces, the tray sheet 9 is surrounded by an edge part 13, on which the tray 1 stands when stored horizontally. The transition regions of the tray sheet 9 to the edge part 13 are rounded. The height of the edge part 13 is such that the cups 3 positioned in the tray 1 remain inside the edge part 13, and on the underside of the tray 1 a plate-shaped receptacle 14 (FIG. 3, FIG. 4) which can be folded open and closed, is surrounded by the edge part 13 in the folded-out condition.

On the second end face of the tray sheet 9 a front part 15 inclined towards the tray sheet 9 is formed, which provides panels 15*a* for the individual labelling of the tray 1, for example with patient information. The panels 15*a*, preferably implemented as shallow depressions, can be provided with adhesive or insertable and removable labels, wherein inserted labels are held by means of retaining tabs 15*b*. FIG. 4 shows the fold-out receptacle 14, which is connected to the inner side of the edge part 13 in a hinge-like manner in the region of the end of the tray 1 opposite the front part 15. In the embodiment shown in the figures, the receptacle 14 is essentially implemented as a rectangular sheet provided with a number of openings—corresponding to the number of containers that can be positioned in the tray 1. By means of snap-fit connections 16, the receptacle 14, preferably near the front part 15, can be snapped into place on the inner side of the edge part 13. The snap-fit connections 16 in the embodiment shown are projections 16*a* formed on the rim of the receptacle 14, which detachably clip into appropriately designed openings 16*b* that are formed on the inner side of the edge part 13 of the tray 1. The receptacle 14 is also provided with a low border 14*a* facing the inner side of the tray 1, so that a leaflet containing further useful and necessary information regarding the administration of the medication can be placed in the receptacle 14 such that it is secured against loss.

In the following, the steps up to the preparation of the state of the delivery-ready condition of the medication tray will now be described by reference to FIGS. 5 to 7. As FIG. 5 shows, the assemblies 7 are firstly inserted into the receiving sites 10 of the tray sheet 9 of the tray 1. The individual containers 2 are then filled with medication in accordance with the prescribed medication for the patient. In the next step the containers 2 are sealed with a plastic film 17. The film 17 consists in particular of a single-ply or multi-ply composite made of PE, PP or PET, has a printable top face, and its underside can be used as a sealing layer for the liquid-tight sealing of the cups 3 by gluing or welding. The film 17 is initially located on a backing paper, and is provided with a number of perforations 18 in accordance with the shape of the outer contours of the containers 2 and/or the lid edges 5, for example a number of "slits" formed by punching. In FIG. 6*a* the slits are shown as solid lines. As FIG. 6*a* shows, between adjacent containers 2 of an assembly 7 the perforation is also a slit 18*a*. The outer dimensions of the film 17 substantially correspond to the outer dimensions of the tray sheet 9. In the surface regions inside the perforations 18 the sealing film 17 has already been printed with information concerning the contents of the containers 2. After the backing paper has been peeled off the film 17, the film is then placed onto the tray sheet 9. In doing so, the film 17 is placed in between positioning tabs 9*a* formed on the longitudinal edges of the sheet 9.

In a cold- or hot-sealing device, which can be a welding unit or an adhesive device, which is not the subject of the invention, the film 17 is then sealed to the surfaces of the lid edges 5 within the perforations 18, in particular, thermally welded or glued, wherein gluing can also be hot-melt bonding, contact bonding, reactive bonding, etc. At the same time as the sealing process, a separation of the containers 2 or their lid edges 5 is carried out by cutting the connections 8, preferably by thermal or mechanical means. In the next step (FIG. 7), the film mesh 17*a*, that part of the film 17 which was not sealed, is torn off along the perforations 18. The containers 2, now each sealed in a liquid-tight manner to the covering film 6, are held in the tray 1 by the protrusions 12 when the unsealed film mesh 17*a* is torn off. The tray 1 is now in the delivery-ready condition.

The trays 1 are designed in such a way that they can be stacked on top of one another with and without container 2 to save space. Since the trays 1 are produced from plastic by injection moulding, they are easily cleanable, preferably in dishwashers, and can be disinfected using commercially available disinfectants.

The containers 2 are removed from the tray 1 individually at the scheduled medication time, wherein to remove the drugs the lid 4 is opened and replaced on the cup 3 if required.

In a further embodiment, not shown, the cups 3 can be produced integrally with an edge part, which has a surface for welding on the foil 17. In this case, the containers can no longer be closed after the removal of the film.

LIST OF REFERENCE NUMERALS

1 tray
2 container
2*a* protrusion
3 cup
3*a* base
4 lid
5 lid edge
6 covering film
7 assembly
8 connection
9 tray sheet
9*a* positioning tab
10 receiving sites
11 elevation
12 protrusion
13 edge part
14 receptacle
14*a* edge
15 front part
15*a* surface
15*b* retaining tab
16 snap-fit connection
16*a* protrusion
16*b* opening
17 plastic film
17*a* film mesh
18 perforation
18*a* slot
19 snap-in connection

The invention claimed is:

1. A medication system comprises:

a medication tray having:

a rectangular tray sheet with a number of individual receiving sites, which are separated from each other and run in rows, and a plurality of containers containing liquid or solid medicines, which are positioned in the receiving sites such that they are individually removable, each container of the plurality of containers has an upper edge with a level surface extending from a contoured outer edge to an upper opening in the level surface, a plurality of plastic films welded on the plurality of containers, each container of the plurality of containers having a plastic film of the plurality of plastic films sealed to only the level surface of the upper edge to cover the upper opening, each plastic film of the plurality of plastic films having a film edge defined by a perforation along the contoured outer edge of the container welded thereto, wherein:

the rectangular tray sheet is a re-usable plastic injection moulded part, and each plastic film of the plurality of plastic films originates from a single flexible plastic film provided with a plurality of perforations along the contoured outer edges of the plurality of containers to define the film edge of each of the plurality of plastic films and a film mesh between the plurality of perforations, wherein the medication tray is devoid of the film mesh, which is removed from the plurality of plastic films at the plurality of perforations.

2. The medication system according to claim 1, wherein the containers of the plurality of containers are positioned in the receiving sites of the tray sheet by means of at least one snap-in connection such that the containers are detachable and reusable.

3. The medication system according to claim 2, wherein the receiving sites are openings in the tray sheet.

4. The medication system according to claim 2, wherein the at least one snap-in connection has at least one projection formed on inner edges of the receiving sites and at least one projection formed on each of the plurality of containers.

5. The medication system according to claim 1, wherein an edge part extending perpendicular to the tray sheet is provided on the two long sides and on one end face of the tray sheet.

6. The medication system according to claim 5, wherein a receptacle for the storage of administration instructions or patient information or the like, is arranged on the edge part of the tray sheet such that the receptacle is pivoted open, wherein the receptacle is detachably connected to the edge part of the tray by means of a snap-fit connection.

7. The medication system according to claim 1, wherein a slanted front part is formed on an end face of the tray sheet with fields for affixing labels.

8. The medication system according to claim 1, wherein each container of the plurality of containers comprises a cup with an upper edge and an edge part of a cover, the edge part of the cover being seated on the upper edge of the cup and providing the level surface, wherein the level surface extends in the plane or parallel to the plane of the tray sheet and to which level surface the plastic film of the plurality of plastic films is sealed, forming a film lid.

9. The medication system according to claim 1, wherein each container of the plurality of containers comprises a cup having an upper rim region providing the level surface, wherein the level surface extends in the plane or parallel to the plane of the tray sheet and to which level surface the plastic film of the plurality of plastic films is sealed, forming a film lid.

10. A method for preparing a delivery-ready medication system with a medication tray, which comprises a rectangular tray sheet with a number of individual receiving sites for containers holding drugs, which are separate from each other and run in rows, the method comprising the following steps:

insertion of the containers, each having an upper edge with a level surface, into the receiving sites of the tray sheet, filling the containers with medications, positioning a single flexible plastic film, which is provided with perforations along outer contours of the containers, on the tray sheet and the containers, wherein the perforations define plastic film covers for the containers separated by a film mesh, sealing the single flexible plastic film only on the level surface of the upper edge of each of the containers, and removing the film mesh from the plastic film covers by cutting through the perforations.

11. The method according to claim 10, wherein when removing the film mesh, each container is held in the tray sheet by at least one snap-in connection-formed by each container and its receiving site.

12. The method according to claim 10, wherein a plurality of the containers are inserted, arranged in a row and connected to each other via connections, wherein the connections are mechanically or thermally separated during the sealing process.

13. The method according to claim 10, wherein the container edges that form the sealing surfaces lie in the plane of the tray sheet.

14. The method according to claim 10, wherein the plastic film is imprinted in the regions surrounded by perforations before being positioned.

15. The method according to claim 10, wherein each of the containers comprises a cup with an upper edge and an edge part of a cover, the edge part of the cover being seated on the upper edge of the cup and providing the said level surface, wherein said single flexible plastic film is sealed only with the level surfaces on the edge parts of the covers of all containers.

* * * * *